US006032727A

United States Patent [19]

Martins

[11] Patent Number: 6,032,727

[45] Date of Patent: Mar. 7, 2000

[54] HEAT EXCHANGER WITH AN ACCESSORY, AND A METHOD OF FASTENING THE ACCESSORY ON THE HEAT EXCHANGER

[75] Inventor: Carlos Martins, Montfort l'Amaury, France

[73] Assignee: Valeo Thermique Moteur, La Verriere, France

[21] Appl. No.: 09/126,047

[22] Filed: Jul. 30, 1998

[30] Foreign Application Priority Data

Aug. 1, 1997 [FR] France ..... 97 09898

[51] Int. Cl.[7] ..... F28D 1/00

[52] U.S. Cl. ..... 165/149; 165/41; 165/121; 165/67; 123/41.49

[58] Field of Search ..... 165/153, 140, 165/176, 149, 41, 121, 67; 123/41.49

[56] References Cited

U.S. PATENT DOCUMENTS

| | | | |
|---|---|---|---|
| 5,269,367 | 12/1993 | Susa et al. | 165/41 |
| 5,597,038 | 1/1997 | Potier | 165/121 |
| 5,638,894 | 6/1997 | Potier et al. | 165/41 |
| 5,667,004 | 9/1997 | Kroetsch | 165/41 |
| 5,771,961 | 6/1998 | Alizadeh | 165/41 |
| 5,791,402 | 8/1998 | Dumetz | 165/149 |

FOREIGN PATENT DOCUMENTS

| | | |
|---|---|---|
| 0 724 071 | 7/1996 | European Pat. Off. . |
| 42 32 019 | 10/1993 | Germany . |

*Primary Examiner*—Ira S. Lazarus
*Assistant Examiner*—Terrell McKinnon
*Attorney, Agent, or Firm*—Morgan & Finnegan, LLP

[57] ABSTRACT

A heat exchanger is provided with a mounting means for fastening an accessory to the heat exchanger. The heat exchanger comprises a set of parallel flat tubes, and a set of cooling fins lying generally at right angles to the planes of the flat tubes and being inserted between two parallel flat tubes. The tubes and the cooling fins are arranged alternately with each other. At least one of the tubes is replaced by a mounting plate having at least one fastening lug projecting from a side edge of the mounting plate. The accessory is attached to the heat exchanger through the fastening lug.

8 Claims, 1 Drawing Sheet

FIG. 1
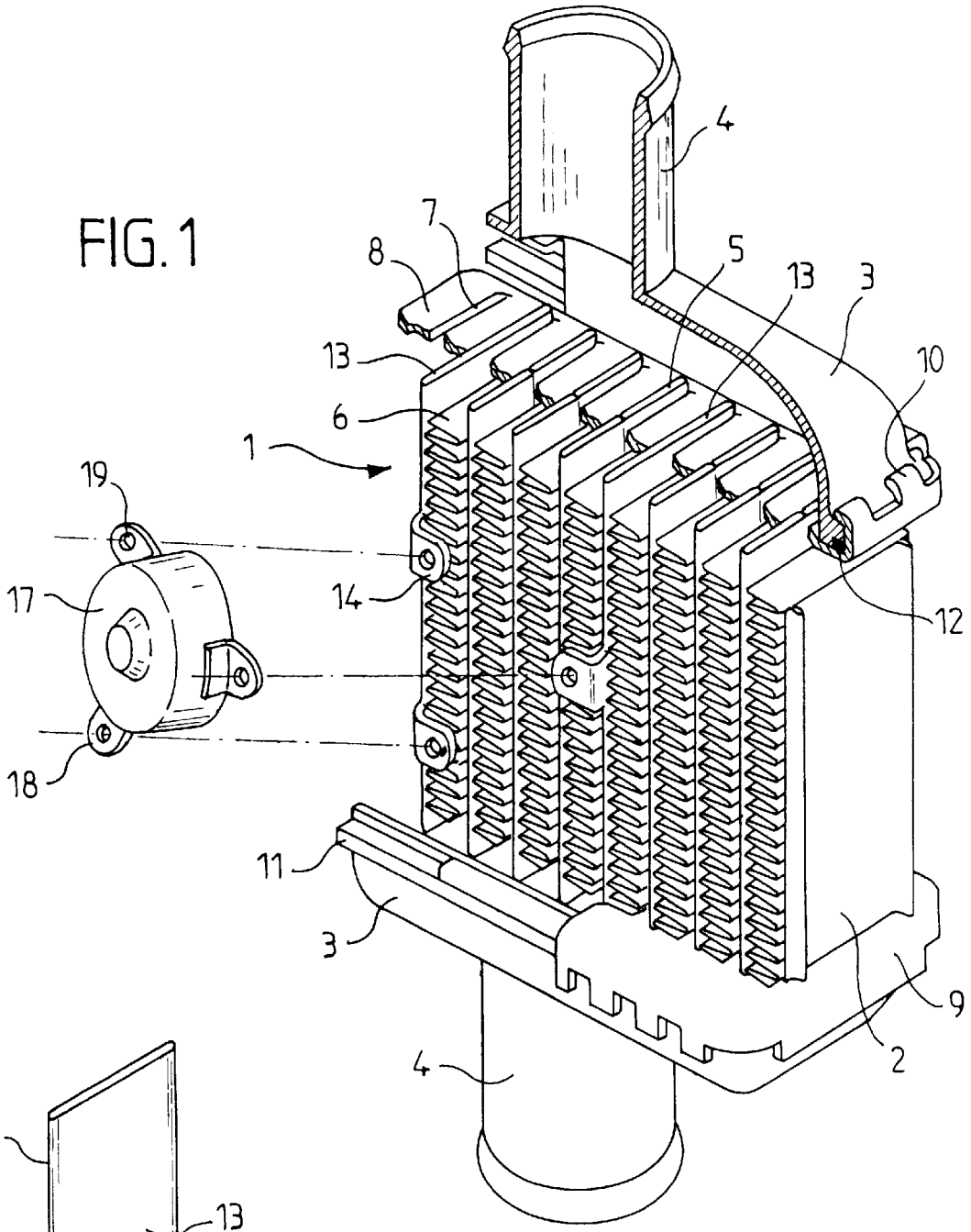
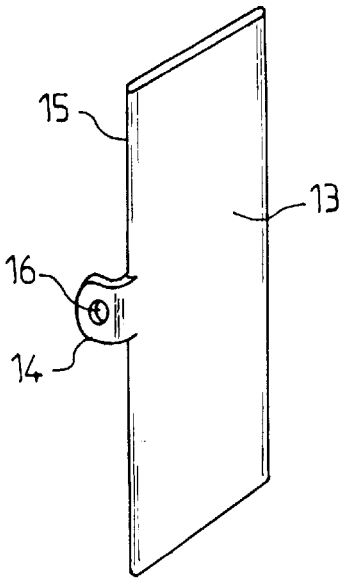
FIG. 2

HEAT EXCHANGER WITH AN ACCESSORY, AND A METHOD OF FASTENING THE ACCESSORY ON THE HEAT EXCHANGER

FIELD OF THE INVENTION

The present invention relates to heat exchangers adapted to carry an accessory, and to methods of fastening an accessory to the heat exchanger. More particularly, the invention relates to heat exchangers for motor vehicles, of the type in which a set of flat tubes disposed in planes parallel to each other are joined together through a set of cooling fin elements having fins disposed generally at right angles to the planes of the tubes. Such heat exchangers, more commonly referred to as radiators, are generally designated by a term such as "heat exchanger with brazed tube bundle", due to the fact that the tubes and the fin elements are assembled together by brazing.

BACKGROUND OF THE INVENTION

It has been proposed in the past to secure an accessory, in particular the electric motor of a motorised fan unit associated with the radiator, directly on the radiator (heat exchanger), instead of fixing it either to cross-members or to elements of the chassis or bodywork of the vehicle as in traditional arrangements.

Up to the present time, this fastening on the heat exchanger has been obtained by fastening the accessory on the side plates of the heat exchanger, or on the water headers, or fluid headers, of the heat exchanger. Although this is generally satisfactory, this arrangement does have the disadvantage that the fastening points of the heat exchanger itself are relatively remote from the accessory to be secured, and that some kind of supplementary fastening member is necessary. Such a fastening member is often relatively difficult to make, and in any case it adds to the cost of the heat exchanger assembly.

In addition, it has been proposed to secure the accessory directly on the tube bundle (or matrix) of the heat exchanger, using fastening members, generally dowels or bars, which pass through the cooling fin elements. This arrangement has the disadvantage that it makes it necessary to form passages through the fin elements.

DISCUSSION OF THE INVENTION

An object of the present invention is to overcome the above mentioned drawbacks. More particularly, an object is to provide a novel method of fastening an accessory to a heat exchanger, which reduces both the cost and the bulk of the heat exchanger assembly, while increasing the choice of positions for mounting the accessory and also the quality of the mounting itself.

According to the invention in a first aspect, a method of fastening an accessory to a heat exchanger, of the type in which an assembly of flat tubes is assembled in planes parallel to each other with the aid of a set of fin elements comprising fins extending generally at right angles to the plane of the tubes, is characterised by the fact that a mounting plate is fitted in place of at least one of the tubes, the or each mounting plate carrying at least one fastening lug projecting from the mounting plate; and the said accessory is secured directly on the fastening lug or lugs.

According to the invention in a second aspect, a heat exchanger of the type in which the tubes in a set of flat tubes disposed in planes parallel to each other are joined together by a set of cooling fin elements comprising fins disposed generally at right angles to the planes of the tubes, and the heat exchanger including means for fastening an accessory thereon, is characterised by the fact that the said fastening means comprise at least one mounting plate disposed in place of at least one of the said tubes and carrying a projecting fastening lug for mounting the accessory on the said lug or lugs.

With the arrangement according to the invention, the accessory, such as the electric motor of a motorised fan unit associated with the heat exchanger, can be secured directly in the desired position, which may be in the actual centre of the matrix (consisting of the tubes and the fin elements) of the heat exchanger, or in any other suitable position, because the fastening lugs project from the body or matrix of the heat exchanger (comprising the tubes and the fins) between two rows of fins.

Fitting of these fastening means is also particularly simple, because no additional operation is necessary besides those in which the heat exchanger matrix is fabricated itself. The mounting plate carrying the fastening lug or lugs can in this connection be mounted exactly like a heat exchanger tube, and in particular by brazing.

Finally, it may be observed that replacement of a tube of the heat exchanger by the plate carrying one or more fastening lugs only slightly alters the thermal performance of the heat exchanger. In this connection, the mounting plate is preferably made of metal, it is intimately coupled thermally with the cooling fin elements that flank it on both sides; and it is located in the stream of cooling air passing through the matrix of the heat exchanger. Consequently, it plays an active part in the heat exchange process itself.

In one particular embodiment of the invention, the mounting plate is a solid plate. In a particular embodiment, again, at least one of the projecting fastening lugs is bent back in a plane at right angles to the plane of the tubes and the plane of the fins, so that it is L-shaped. This last mentioned arrangement enables an electric motor, in particular, to be easily fitted, the motor itself having fastening lugs extending at right angles to its axis and arranged to be secured directly on the fastening lugs of the heat exchanger.

Further features and advantages of the invention will appear more clearly on a reading of the following description of a preferred embodiment of the invention, which is given by way of non-limiting example only and with reference to the accompanying drawings.

BRIEF DESCRIPTION OF THE DRAWINGS

FIG. 1 is a perspective view, partly cut away, of part of a heat exchanger according to the present invention.

FIG. 2 is a perspective view of a support plate of the same heat exchanger.

DESCRIPTION OF A PREFERRED EMBODIMENT OF THE INVENTION

The heat exchanger shown in FIG. 1 is for example the cooling radiator for the engine of a motor vehicle. It comprises a heat exchanger body or matrix 1, which is disposed between two side plates 2, only one of which is shown in FIG. 1; and, at each end of the heat exchanger (in this example the top end and the bottom end) a water header 3. Each water header has an external pipe connection 4. The matrix 1 consists essentially of a set of flat metal tubes 5, in which the fluid to be heated or cooled flows, together with a set of cooling fin elements 6 arranged alternately with the tubes 5. The tubes 5 are open into the headers 3, and are disposed in planes parallel to each other. The tubes 5 are joined together through the fin elements 6, each of which defines a set of cooling fins disposed substantially at right angles to the plane of the tubes 5. The fin elements 6 are made in the form of metal strips corrugated accordion fashion, and are also referred to as inserts. The tubes 5 and the inserts 6 are secured together by brazing, and the matrix is so constructed that the front edges of the tubes and those of the fins lie in a common plane, which is the front plane of the heat exchanger. The tubes 5 extend beyond the fins 6 at both the top and bottom ends of the matrix. The tubes are engaged in apertures 7 formed in header plates 8, one at each end of the tubes, and the connection between the tubes and the header plates 8 is made in any suitable way, for example by force-fitting and brazing.

The header plates 8 include flanges 9 along their perimeter, and seaming lugs 10 projecting from these flanges. Each header 3 comprises a header cover, including the respective pipe connection 4, and the corresponding header plate. Each header cover is secured on its header plate by upsetting the flanges 9 substantially at right angles to the header plate 8 towards the header cover, after which the seaming lugs 10 are bent tack substantially parallel to the header plate 8. The seaming lugs 10 are seamed over a seaming bead 11 which is formed around the perimeter of the header cover 3. A sealing gasket 12 is also arranged around this perimeter so as to provide sealing of the header 3.

The set of tubes 5 does not consist only of hollow tubes for fluid flow, for at least one of the tubes 5 (two in this example) is replaced by a solid mounting plate 13. Each plate 13 has the same flat external form as a hollow tube 5. The mounting plates 13 are secured by brazing, in the same way as the tubes 5, between two fin inserts 6. Each mounting plate 13 carries a lug or lugs projecting from its front edge 15, so that after assembly, these lugs project from the front plane of the matrix 1 of the heat exchanger.

The lugs 14 are integral with the mounting plates 13, and in this example they are bent back at right angles, so as to lie in a plane parallel to the front plane of the heat exchanger and therefore at right angles to the planes of the mounting plates 13 and the planes of the fins 6. Each lug 14 has a fastening hole 16.

FIG. 1 shows how these lugs 14 are used for mounting the electric motor 17 of the motorised fan unit associated with the heat exchanger. The fan itself is not shown. One of the mounting plates 13 has one mounting lug 14, while the other plate 13 has two of these lugs. The lugs 14 are so arranged that their respective holes 16 lie substantially at the three corners of an equilateral triangle.

As to the motor 17, this has three mounting lugs 18 which are spaced apart at regular intervals (120°) about its axis. The lugs 18 lie in a plane at right angles to the axis of the motor 17, and are themselves formed with fastening holes 19. Mounting of the motor on the heat exchanger is carried out very simply by securing the lugs 19 directly on the lugs 14 by means of suitable screw fasteners.

The accessory, such as the motor in this example, is thus very easily fitted, without any intermediate component, directly on the matrix of the heat exchanger. The fastening points are also in immediate proximity to the accessory.

What is claimed is:

1. A heat exchanger comprising: a set of flat tubes disposed in parallel planes; a row of cooling fins inserted between two adjacent flat tubes; and a fastening means for fastening an accessory in position on the heat exchanger, wherein the fastening means comprises at least one mounting plate disposed in place of at least one of the tubes and having at least one fastening lug projecting from a side of the mounting plate.

2. The heat exchanger according to claim 1, wherein the at least one mounting plate is a solid plate.

3. The heat exchanger according to claim 1, wherein the at least one fastening lug is bent back in a plane substantially at right angles to the planes of the flat tubes.

4. The heat exchanger according to claim 3, wherein the at least one fastening lug is bent back at 90° from the planes of the flat tube, wherein the at least one fastening lug forms an L-shape with the mounting plate.

5. The heat exchanger according to claim 1, wherein the accessory is an electric motor of a motorised fan unit.

6. A method of manufacturing a heat exchanger having a means for mounting an accessory on the heat exchanger, the method comprising the steps of:

providing a set of parallel tubes having at least one mounting plate disposed therein, the at least one mounting plate having at least one fastening lug projecting at a substantially perpendicular angle from a side of the mounting plate;

inserting and attaching a row of cooling fins between two adjacent parallel flat tubes.

7. A heat exchanger comprising:

a set of parallel tubes;

at least one mounting plate disposed in the set of parallel tubes, the at least one mounting plate having at least one fastening lug projecting at a substantially perpendicular angle from a side of the mounting plate; and a row of cooling fins inserted between and attached to every two adjacent parallel flat tubes and between the at least one mounting plate and an adjacent parallel flat tube.

8. The heat exchanger of claim 7 comprising two mounting plates.

* * * * *